US006189821B1

(12) United States Patent
James

(10) Patent No.: US 6,189,821 B1
(45) Date of Patent: Feb. 20, 2001

(54) APPARATUS FOR PLASTIC PARTICLE REDUCTION USING DOVE-TAILED BLADE

(76) Inventor: Raymond James, 86-17$^{th}$ Ave., Milton, WA (US) 98354

( * ) Notice: Under 35 U.S.C. 154(b), the term of this patent shall be extended for 0 days.

(21) Appl. No.: 09/276,256

(22) Filed: Mar. 25, 1999

(51) Int. Cl.$^{7}$ ..... B02C 7/12
(52) U.S. Cl. ..... 241/297; 241/298; 241/300
(58) Field of Search ..... 241/296, 297, 241/298, 300, 261.3

(56) References Cited

U.S. PATENT DOCUMENTS

| | | | | |
|---|---|---|---|---|
| 161,097 | * | 3/1875 | Carvill et al. | 241/298 |
| 3,941,319 | | 3/1976 | Pallmann . | |
| 4,213,572 | | 7/1980 | Pallmann . | |
| 4,274,602 | * | 6/1981 | Johansson | 241/298 |
| 4,351,489 | * | 9/1982 | Laptev et al. | 241/261.3 |
| 4,355,768 | * | 10/1982 | Johansson | 241/261.3 |
| 4,610,400 | * | 9/1986 | Sjobom | 241/261.2 |
| 5,217,424 | | 6/1993 | Pallmann . | |
| 5,348,064 | | 9/1994 | Nettles et al. . | |
| 5,725,464 | | 3/1998 | Pallmann . | |
| 5,730,375 | | 3/1998 | Cranfill et al. . | |

* cited by examiner

*Primary Examiner*—John M. Husar
(74) *Attorney, Agent, or Firm*—Davis Wright Tremaine LLP

(57) ABSTRACT

The present invention is in the field of grinders and pulverizers. More specifically, the present invention provides grinders that reduce the size of plastic and other polymeric particles through circular shaped grinding rings. The present invention further provides an apparatus that reduces the time required replacing worn blade segments and, increases grinding or pulverizing efficiency. With the present invention, when the blade segments wear, an adapter ring is unbolted from a drive ring, and once removed, individual blade segments fitted onto the adapter ring slide out of the adapter ring for replacement or sharpening, without the need to unbolt individual blade segments. In the preferred embodiment, the present invention comprises a dovetail type fitting wherein, the male section of the dovetail fitting is connected to the blade segment and the female section of the dovetail fitting is connected to the adapter ring.

15 Claims, 8 Drawing Sheets

APPARATUS FOR PLASTIC PARTICLE REDUCTION USING DOVE-TAILED BLADE

TECHNICAL FIELD OF THE INVENTION

The present invention is in the field of grinders and pulverizers. More specifically, the present invention provides grinders which reduce the size of plastic and other polymeric particles through circular shaped grinding rings. The present invention further provides an apparatus that reduces the time required replacing worn blade segments, and increases grinding or pulverizing efficiency.

BACKGROUND OF THE INVENTION

Many industrial applications require the grinding and pulverizing of plastic and other polymeric components. A common grinding machine utilizes a circular shaped drive ring, commonly about two feet in diameter, orientated substantially in the plane which is perpendicular to the ground, and which is attached to a motor-driven rotatable shaft. The drive ring has attached to it numerous blade segments, usually a total of between 14 and 60, and each blade segment contains a plurality of blades. In the grinding machines in current use, the segments are attached to the drive ring using at least one direct fastener, such as a bolt. Usually the blade segments are attached using two bolts.

Bolting the blade segments to the drive ring provides a secure connection during the grinding or pulverizing process, but this connection mechanism causes production inefficiency and other problems. When blades are worn, the operator must replace the blade segments. It takes extensive time to replace the blade segments, because each segment must be unbolted and, after sharpening or replacement, re-bolted to the drive ring. Even with automated equipment for removing and installing the bolts, the exchange process can require 4 to 6 hours to complete. Extensive replacement time results in the manufacturer losing machine operation time, or having to invest in a redundant drive ring-blade segment set. This poses a problem to the industrial plastic grinder or pulverizer, because many cannot afford to purchase duplicate drive ring sets for immediate replacement or afford to pay for machine operators to replace blade segments.

Additionally, worn blade segments are sharpened by re-cutting groves into the surface of the blade segment. The bolting mechanism requires that the blade segments contain threaded longitudinal grooves. Threaded grooves require a minimum thickness in the blade segments and, therefore, reduce the width of the blade segment available for resharpening.

A solution to this problem was attempted by eliminating the bolt attachment, and fixing blade segments in place using pressure or clamping, such as disclosed in U.S. Pat. No. 3,941,319. This approach does not provide a complete solution because it relies on clamping or overt pressure to fix the blade segments in place. This approach resulted in additional components that impede the grinding or pulverizing process and, in some cases, failed to adequately fix the blade segments in place.

SUMMARY OF THE INVENTION

The present invention is an apparatus for grinding polymeric materials comprising (a) a drive ring receivable onto a rotatable shaft and having (i) a first flat surface, (ii) a second flat surface; wherein the first flat surface is orientated in a first plane, the second flat surface is orientated in a second plane, and the first flat surface plane is separate from the second flat surface plane; and wherein the drive ring defines a recess adjacent to the drive ring first flat surface and defined by (i) an inner wall orientated in a plane, (ii) an outer wall oriented in a plane and (iii) an interior flat surface oriented in a plane and which comprises an inner edge and an outer edge wherein (A) the inner edge of the interior flat surface is connected to the inner wall, and (B) the outer edge of the interior flat surface is connected to the outer wall; (b) a plurality of blade segments forming a plane; (c) an adapter ring which is substantially the same size and shape as the drive ring recess, forming a plane, (d) a means for connecting the blade segments to the adapter ring whereby, (i) the blade segments received into the adapter ring are precluded from moving in a plane which is substantially perpendicular to the plane of the adapter ring and blade segment combination and (ii) the blade segments freely move in the plane which is substantially the same as the plane of the adapter ring and blade segment combination; and (e) a means for connecting the adapter ring to the drive ring, wherein (i) the adapter ring connected to the drive ring is insertable into and maintained in the drive ring recess and (ii) the blade segments received into the adapter ring which is connected to the drive ring are precluded from moving in the plane which is substantially the same as the plane of the adapter ring and blade segment combination.

In an embodiment of the present invention, the means for laterally receiving blade segments into the adapter ring is selected from the group consisting of (a) a plurality of tongue and groove fittings, (b) a plurality of dove-tail shaped fittings and (c) a plurality of inverted "T" shaped fittings. In the preferred embodiment of the present invention, the dovetail shaped fitting angle of incidence is about 60 degrees. In one embodiment of the present invention, the dovetail shaped fitting has a male section and a female section, wherein the male section of the dovetail is connected to the blade segment and the female section of the dovetail is connected to the adapter ring. In another embodiment of the present invention, the dovetail shaped fitting has a male section and a female section, wherein the male section of the dovetail is connected to the adapter ring and the female section of the dovetail is connected to the blade segment.

In another embodiment of the present invention, the drive ring is substantially circular-shaped, the drive ring recess is substantially ring-shaped and the adapter ring is substantially ring-shaped.

In another embodiment of the present invention, the drive ring further defines a plurality of holes in the drive ring recess. In the preferred embodiment of the present invention, the drive ring further defines about 120 holes in the drive ring recess.

In another embodiment of the present invention, the means for connecting the adapter ring to the drive ring comprises (a) at least one flange tab connected to the outer edge of the adapter ring wherein the flange tab is adapted to receive a fastener therein; and (b) at least one hole in the drive ring, wherein the hole is positioned opposite the flange tab and the hole is adaptable to receive a faster therein. In the preferred embodiment, the present invention comprises 8 flange tabs and corresponding drive ring holes.

DETAILED DESCRIPTION OF THE INVENTION

The present invention solves the problem of extended blade replacement times dragging down productivity or requiring expensive capital expenditure to have spare drive ring and blade segments for ready replacement. The present invention eliminates the need for fasteners to attach the blade segments (1) to the drive ring (3). The present invention does not require additional components on top of the blades that interfere with grinding or pulverizing. The present invention utilizes an adapter ring (2) into which the blade segments (1) are inserted using a tongue and groove type fitting, such as a dovetail, and this fitting prevents longitudinal movement of the blade segments. The adapter ring (2) is inserted into a recess in the drive ring (3), and the edges of the drive ring recess prevent lateral movement of the blade segments (1). The adapter ring (2) is connected to the drive ring (3) with a few bolts, usually 8 or less. The drive ring (3), adapter ring (2) and plurality of blade segments (1) provide a grinding apparatus in which the blade segments are securely fixed during grinding or pulverizing operations, but which are quickly replaced, usually in about 15 minutes.

Figure 7:
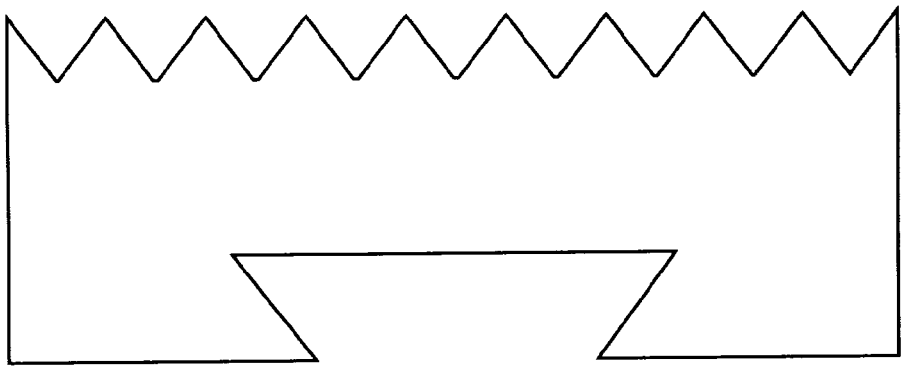
FIG. 7 shows a single blade segment element of the present invention, to highlight another embodiment of the present invention, shown as a dovetail type fitting with the female section of the fitting connected to the blade segment.
Figure 8:
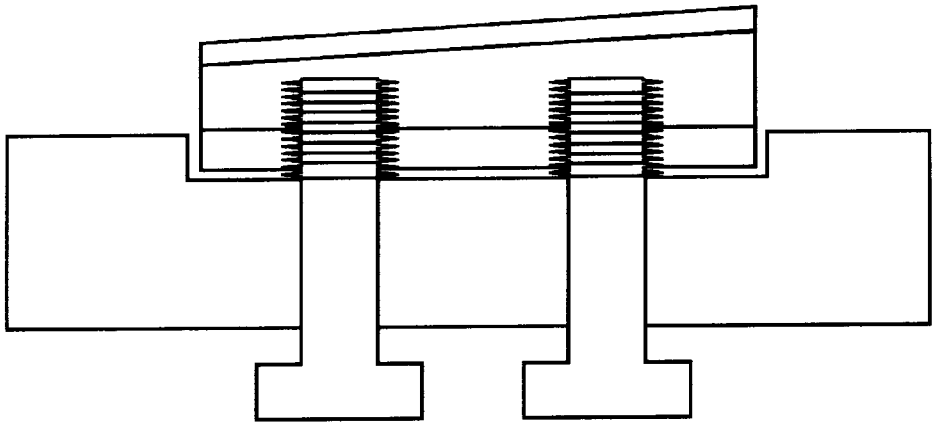
FIG. 8 shows a cutout side view of a single current art blade segment, which is bolted to a drive ring.

The present invention incorporates a novel blade segment (1) design, each with a plurality of blades (1A), into a grinding or pulverizing ring apparatus, which surprisingly accomplishes decreased blade segment (1) replacement time, and other added benefits. The individual blade segments (1) are inserted into the ring adapter (2) using a tongue and groove method, for example, a dove-tail type of insert (1B, 2A, FIG. 4, FIG. 7). The preferred embodiment of the present invention uses a dove-tail type tongue and groove fitting, but the invention encompasses other configurations, that allow lateral movement, but prevent longitudinal movement, including, but not limited to, an inverted "T."

Figure 1:
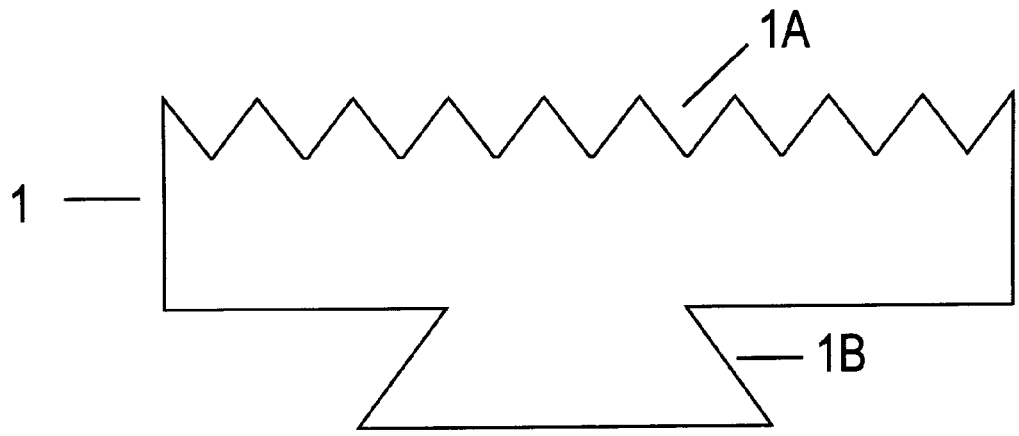
FIG. 1 shows an end view of a single blade segment element of an embodiment of the present invention, to highlight the male section of the dovetail type fitting (1B), and the plurality of grinding blades (1A).
Figure 4:
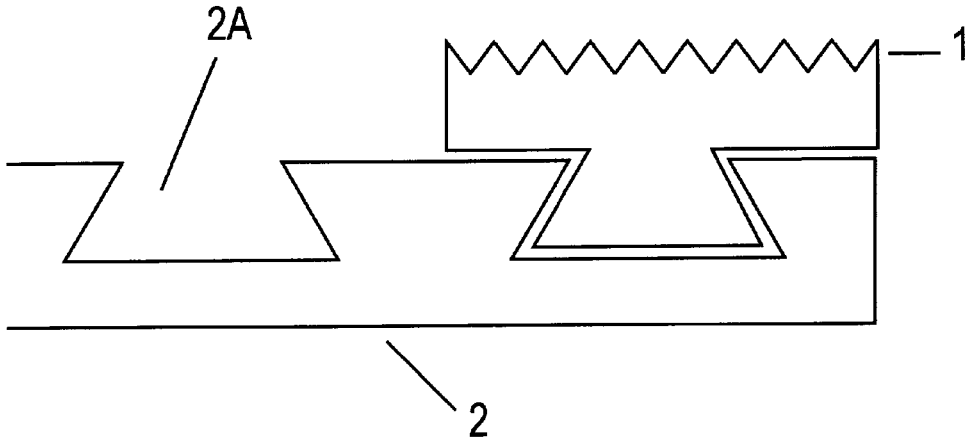
FIG. 4 shows a cutout side view of the adapter ring (2) element of an embodiment of the preferred invention, to show the adapter ring slot (2A) and a blade segment (1) inserted therein, shown as a dovetail type fitting.

The placement of the male and female sections of the dovetail may be on either the blade segment or the adapter ring. The preferred embodiment is to have the male section of the dove tail (1B) on the blade segment (FIG. 1) while the female section (2A) is on the adapter ring (FIG. 4). It is possible, however, to have the female dovetail section on the blade segment (FIG. 7) and the male section in the adapter ring.

Figure 2:
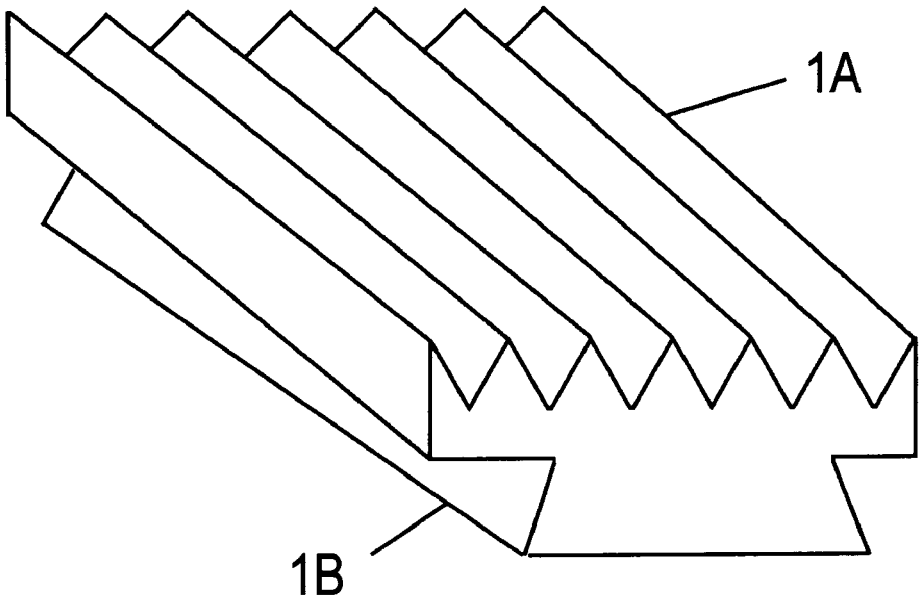
FIG. 2 shows an isometric view of a single blade segment element of an embodiment of the present invention, to highlight the taper of the blade segment along its length.
Figure 5:
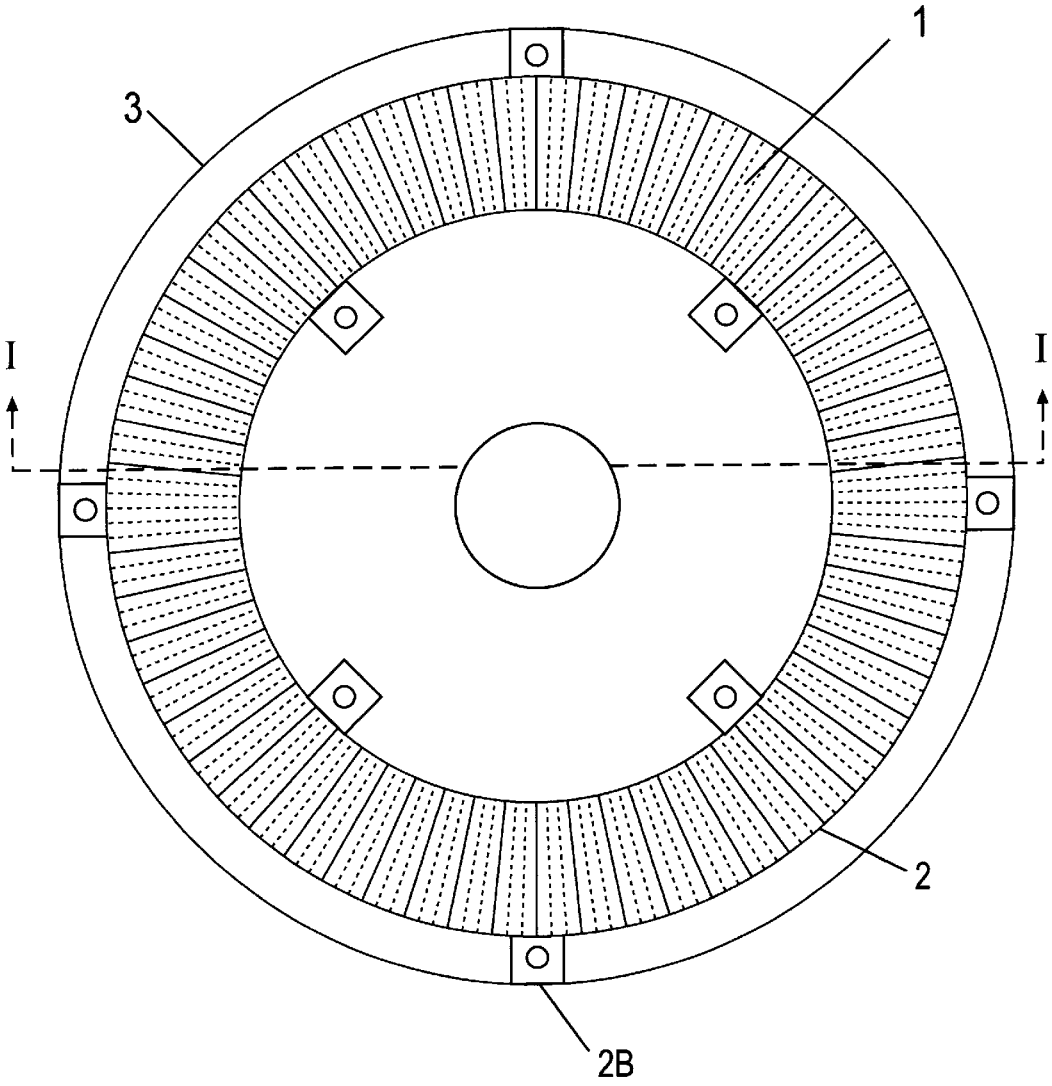
FIG. 5 is a top view of an embodiment of the present invention, and shows a drive ring (3), an adapter ring (2) with a plurality of blade segments (1) inserted into the adapter ring (2), and with adapter ring flanges (2B) to connect the adapter ring to the drive ring.

The blade segment (1) is tapered (FIG. 2) such that when the blade segments (1) are lined-up together, they create a substantially circular shape (FIG. 5). The actual taper depends on the total number of blade segments (1) in the adapter ring (2) and the diameter of the adapter ring (2). In the preferred embodiment, there are 60 blade segments (1) in an adapter ring (2) that measures about 23 inches in diameter. In this embodiment, the blade segment (1) has a width of about 0.864 inches on the end of the blade segment (1) closest to the center of the adapter ring (2), and a width of about 1.208 inches on the end of the blade segment (1) farthest from the center of the adapter ring (2). The blade segments (1) are about 3.33 inches long.

The blade segments (1) are inserted into the adapter ring (2) by inserting the tabs on the blade segment (1B) into the adapter ring slots (2A). The blades segments (1) freely move in the lateral direction, that is, the direction that resides substantially within the plane in which the blade segments (1) and adapter ring (2) reside. The blade segments (1) which are inserted into the adapter ring (2) cannot mover longitudinally, that is, cannot move in the direction that resides substantially within the plane which is perpendicular to the plane in which the blade segments and the adapter ring reside, because of the tongue and groove fitting.

The adapter ring (2) and blade segments (1) are constructed using steel, such as hot-rolled steel, mild steel, D2 steel, or the like. D2 steel is preferable for the blade segments (1), because D2 steel is harder and better suited to grinding and pulverizing plastic. The tongue and groove elements (1B, and 2A) are constructed using standard machining techniques; such as with computer numerically controlled (CNC) machines.

To make the grove, such as the female section of a dovetail fitting (2A), first a slot is machined into the adapter ring (2) with the width of the slot equal to the narrow portion of the dovetail fitting. In the preferred embodiment, the width of the top notch is about 0.466 inches. A dovetail-making tool creates the dovetail female section. The dovetail female section is constructed in two steps, with a first step requiring a rough dovetail cutting tool, and the second step requiring a finishing dovetail cutting tool. The best results are obtained using carbide-tipped cutting tools. The male section of the dovetail fitting is reciprocally constructed to create the matched fitting. In another embodiment of the present invention, the slot is machined into the blade segment (FIG. 7), and the matching dovetail male is machined into the adapter ring.

During the machining process, it is preferred to flood the parts with a coolant (which are commonly used in the machining industry). The coolant flood will maintain a low part temperature, for example, the temperature of the adapter ring (2) or blade segment (1), which is important when cutting to the precise tolerances required for the tongue and groove fitting (1B, 2A). While it is possible to machine the parts "dry," i.e., without coolant, the temperature of the part increases during "dry" machining and reduces the precision of the cuts, which can result in the tongue and groove fittings not meshing precisely. Misting the parts with coolant during machining is not as effective as flooding for maintaining a low part temperature.

The angle of incidence for the dovetail should be greater than 45 degrees, to prevent blade segments from detaching from the drive ring during grinding or pulverizing operations, or causing other malfunctions. Also, the overall height of the dovetail section, i.e., the actual distance from the broad base to the narrowed neck, should be greater than 0.100 inch. The preferred angle of incidence of the dovetail is 60 degrees, and the preferred overall linear height of the dovetail section is 0.150 inch.

Figure 6:
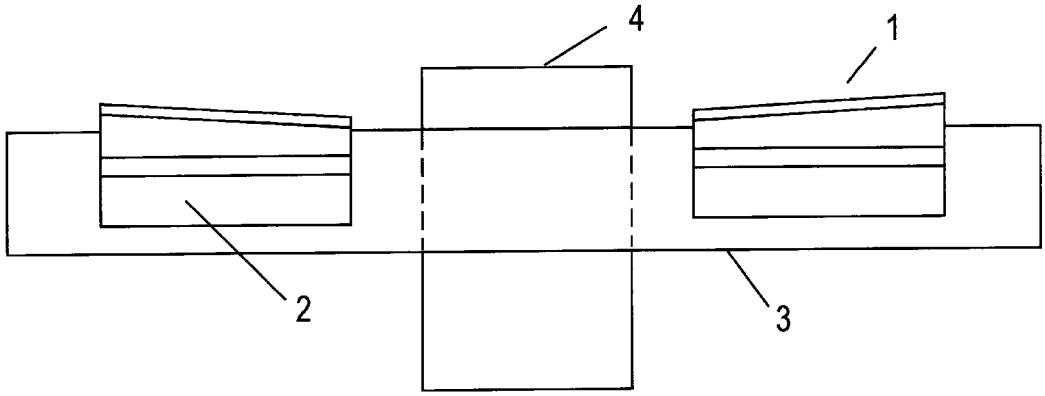
FIG. 6 shows a cutout side view of an embodiment of the present invention as set forth in FIG. 5, along site line A, and shows the drive ring (3), adapter ring (2) and blade segments (1).

The adapter ring (2) and plurality of blade segments (1) are inserted into a recess in the drive ring (3) (FIGS. 5 and 6). The drive ring (3) recess is about 1 to 3 inches in depth. The walls of the drive ring (3) recess extend beyond the tongue and groove fitting of the adapter ring (2) and blade segment (1), and provide a stop to the lateral movement of the blade segments (FIG. 6). The walls of the drive ring recess must not extend beyond the blades (1A) of the blade segments (1), that is, the drive ring recess must not be too deep, because the blades must reside substantially in a plane which is out from the plane of the drive ring (3) surface in order to provide blades to perform the grinding or pulverizing operations.

When the blade segments (1) are inserted into the adapter ring (2), the tongue and groove fitting, e.g., the dove-tail fitting, prevents longitudinal movement of the blade segments (1). When the adapter ring (2) and blade segment (1) combination is inserted into the drive ring (3) recess, the walls of the drive ring recess prevent the lateral movement of the blade segments. Thus, connecting the plurality of blade segments (1) to the adapter ring (2), and further connecting to the drive ring (3), the blade segments (1) are, therefore, fixed during the grinding or pulverizing operations.

Figure 3:
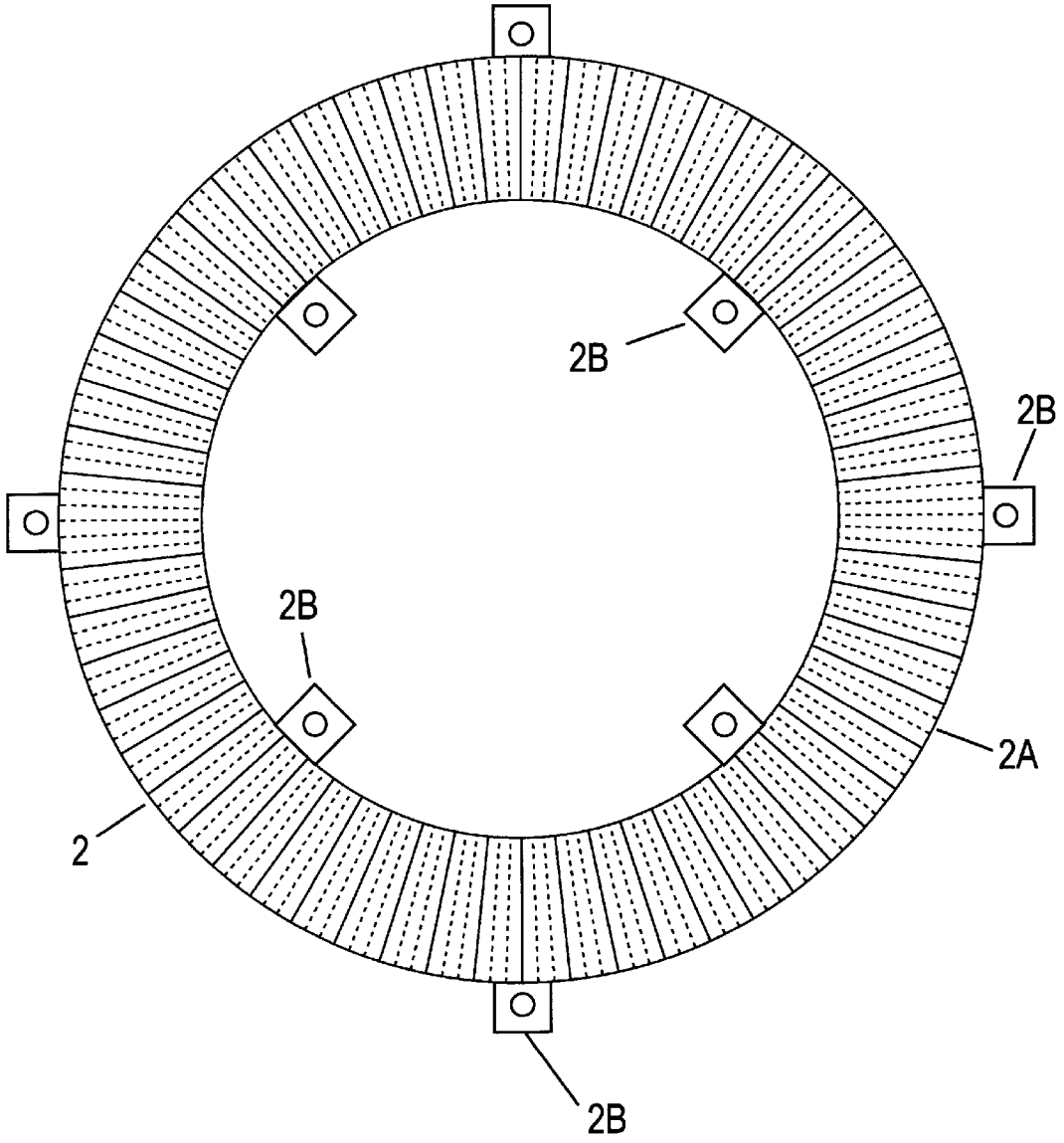
FIG. 3 shows a top view of the adapter ring (2) element of an embodiment of the present invention, with a plurality of lateral slots for the blade segments (2A), and with flanges (2B) for fastening to the drive ring.

A preferred embodiment of the present invention further comprises flanges (2B) on the adapter ring (2) (FIG. 3). The flanges are used to bolt the adapter ring (2) into the drive ring (3). The drive ring (3) has an insert machined out to accept the adapter ring flange (2B), and holes machined into it, which are tapped to receive a threaded bolt. The bolts are inserted into the adapter flanges (2B) and then secured to the drive ring (3). In the preferred embodiment of the present invention, the adapter ring (2) has eight flanges (2B), four flanges connected to the outer edge of the adapter ring (2) and four connected to the inner edge of the adapter ring (2, FIG. 3).

In another embodiment of the present invention, the width of dovetail male section (1B) tapers slightly throughout the length of the blade segment (1). The reason for this taper is to provide some slight frictional resistance to the blade segments (1) falling out of the adapter ring (2) during installation into the drive ring (3). This frictional resistance assists when inserting the adapter ring (2) into the drive ring (3), because the drive ring (3) is installed in a vertical manner onto a drive shaft (4, FIG. 6, shown in the horizontal position). This means that the adapter ring (2) must be tilted 90 degrees to complete installation. As the adapter ring (2) is tilted, there is no positive force holding the blade segments (1) in place, because it is the backing of the drive ring recess in the drive ring (3) that provides the lateral resistance during the grinding and pulverizing operations (FIG. 6). By tapering the dovetail male section (1B) slightly, this frictional resistance prevents the blade segments (1) from falling out during the short time the adapter ring (2) is vertical, just prior to being fit onto the drive ring (3). The taper may be between about 0.007 to about 0.010 inches. If the taper is too large, the blade segments (1) will be difficult to insert into and remove from the adapter ring (2). If the taper is too small, the blade segments will fall out during installation of the adapter ring (2) onto the drive ring (3). In the preferred embodiment, the taper is a difference of 0.008 inches, that is, the outer end of the blade segment male dovetail (1B) is 0.008 inches wider than the inner end. In the preferred embodiment, the outer taper of the male section of the dovetail (1B) is 0.462 inches wide, and the inner taper of the male section of the dovetail is 0.452 inches wide.

Another method for slightly securing the blade segments (1) into the adapter ring (2) to inhibit blade segments from falling out during installation of the adapter ring (2) onto the drive ring (3) is to provide each blade segment (1) with a small set screw which is tightened to provide the frictional resistance to falling while vertical.

The drive ring (3), into which the adapter ring (2) is placed, typically have between about 20 and 140 holes in the drive ring (3) recess, because they have previously been used with blade segments that bolt into the drive ring. The holes in the recess of the drive ring are not used in the present invention, and remain open holes. An added benefit to the present invention is that the holes act as a conduit for removing heat from the grinding ring assembly during grinding or pulverizing operations. Most grinding or pulverizing machines have controls that shut down the machines once an elevated temperature is reached, such as 150 degrees Fahrenheit. For some operators located in regions of the United States with high ambient temperatures, machines would shut down regularly due to overheating. With the holes open, that is, not occupied by bolts, the heat reducing effects means that machines can operate longer without being subject to shut down for cooling.

When the blade segments (1) in the present invention wear, the operator does not unfasten each individual blade segment (1). Rather, the operator merely unbolts the adapter ring (2) and removes the adapter ring (2) from the drive ring (3). Once removed, the individual blade segments slide out of the adapter ring for replacement or sharpening.

With the present invention, when the blade segments (1) wear, the grinding machine operator does not need to unfasten each individual blade segment (1). Rather, the operator merely unbolts the adapter ring (2) and removes the adapter ring (2) from the drive ring (3). Once removed, the individual blade segments (1) slide out of the adapter ring (2) for replacement or sharpening. The present invention solves the problem of blade replacement time dragging down productivity or requiring expensive capital expenditure to have spare drive ring and blade segments for ready replacement.

What is claimed is:

1. An apparatus for grinding polymeric materials comprising:

(a) a drive ring receivable onto a rotatable shaft and having an annular drive ring recess therein;

(b) an adapter ring having substantially the same size and shape as the annular drive ring recess, wherein the adapter ring fits into the annular drive ring recess and is attached to the drive ring; and (c) a plurality of blade segments attached to the adapter ring.

2. The apparatus of claim 1 wherein the plurality of blade segments are attached to the adapter ring using an attachment means selected from the group consisting of (a) a plurality of tongue and groove fittings, (b) a plurality of dovetail shaped fittings and (c) a plurality of inverted "T" shaped fittings.

3. The apparatus of claim 2 wherein the means for attaching the blade segments to the adapter ring further comprises means to preclude the blade segments from moving in a radial direction in response to a force equal to or less than the force of gravity.

4. The apparatus of claim 1 wherein the plurality of blade segments are attached to the adapter ring using a plurality of dovetail fittings wherein a dovetail angle of incidence is about 60 degrees.

5. The apparatus of claim 1 wherein the annular drive ring recess has a plurality of holes therein, wherein each hole extends through the drive ring.

6. The apparatus of claim 4 wherein there are between about 20 holes and about 140 holes in the annular drive ring recess.

7. The apparatus of claim 1 wherein each blade segment comprises a dovetail-shaped male section and the adapter ring comprises a plurality of dovetail-shaped female sections, and wherein the dovetail-shaped male section is tapered to prevent the plurality of blade segments from moving in a radial direction in response to the force of gravity before the adapter ring is attached to the drive ring.

8. The apparatus of claim 1 wherein the adapter ring has a flange projecting from an outer edge thereof, and wherein the adapter ring is attached to the drive ring using a fastener inserted into a hole in the drive ring through a hole in the flange.

9. An apparatus for grinding polymeric materials comprising:

(a) a substantially annular drive ring receivable onto a rotatable shaft and having an annular drive ring recess therein;

(b) a substantially circular adapter ring having substantially the same size and shape as the annular drive ring recess and having a flange projecting from an outer edge thereof, wherein the adapter ring fits into the annular drive ring recess and is attached to the drive ring using a fastener inserted into a hole in the drive ring through a hole in the flange; and (c) a plurality of blade segments attached to the adapter ring.

10. The apparatus of claim 9 wherein the plurality of blade segments arc attached to the adapter ring using an attachment means selected from the group consisting of (a) a plurality of tongue and groove fittings, (b) a plurality of dovetail shaped fittings and (c) a plurality of inverted "T" shaped fittings.

11. The apparatus of claim 9 wherein the plurality of blade segments are attached to the adapter ring using a plurality of dovetail shaped fittings wherein a dovetail angle of incidence is about 60 degrees.

12. The apparatus of claim 9 wherein the annular drive ring recess has a plurality of holes therein, wherein each hole extends through the drive ring.

13. The apparatus of claim 12 wherein there are between about 20 holes and about 140 holes in the annular drive ring recess.

14. The apparatus of claim 9 wherein the adapter ring has (i) 4 outer flanges connected to and about equally spaced along a circumference of the outer edge of the adapter ring, and (ii) 4 inner flanges connected to and about equally spaced along a circumference of an inner edge of the adapter ring, and wherein the positions of the outer flanges and inner flanges are offset from each other by about 45 degrees.

15. An apparatus for grinding polymeric materials comprising:

(a) a substantially annular drive ring receivable onto a rotatable shaft and having an annular drive ring recess therein;

(b) a substantially circular adapter ring having substantially the same size and shape as the annular drive ring recess and having a flange projecting from an outer circumference thereof, wherein the adapter ring fits into the annular drive ring recess and is attached to the drive ring using a fastener inserted into a hole in the drive ring through a hole in the flange; and (c) a plurality of blade segments attached to the adapter ring using a plurality of dovetail shaped fittings, each having a male section and a female section, wherein (i) the dovetail angle of incidence is about 60 degrees, (ii) the male section of the dovetail is connected to the blade segment, and (iii) the female section of the dovetail is connected to the adapter ring.

* * * * *